United States Patent [19]

Scherzinger

[11] 3,981,159

[45] Sept. 21, 1976

[54] TEXTILE-PATTERN-PEG SELECTION AND INSERTION ARRANGEMENT

[75] Inventor: Werner Scherzinger, Bisingen, Germany

[73] Assignee: Mayer & Cie. Maschinenfabrik, Tailfingen, Germany

[22] Filed: Sept. 4, 1974

[21] Appl. No.: 503,512

[30] Foreign Application Priority Data

Sept. 5, 1973 Germany ..... 2344634

[52] U.S. Cl. ..... 66/1 R; 29/208 R

[51] Int. Cl.[2] ..... D04B 37/00

[58] Field of Search ..... 66/1 R, 50 B, 157; 29/208 R, 211 R, 211 M, 212 R

[56] References Cited

UNITED STATES PATENTS

| | | | |
|---|---|---|---|
| 3,138,853 | 6/1964 | Pearl | 29/208 R |
| 3,747,191 | 7/1973 | Kuhn et al. | 29/211 R |
| 3,894,406 | 7/1975 | Christopoulos | 66/1 R |
| 3,911,695 | 10/1975 | Piro | 66/1 R |
| 3,935,629 | 2/1976 | Piro | 29/208 R X |

FOREIGN PATENTS OR APPLICATIONS

| | | | |
|---|---|---|---|
| 1,244,060 | 8/1971 | United Kingdom | 66/1 R |

OTHER PUBLICATIONS

Burnip, Hughes, & Newton, *The Hosiery Trade Journal*, June 1972, pp. 112–114.

*Primary Examiner*—Mervin Stein
*Assistant Examiner*—Andrew M. Falik
*Attorney, Agent, or Firm*—Michael J. Striker

[57] ABSTRACT

In a patterning arrangement for textile machines and the like, particularly for circular knitting machines, of the type wherein pattern pegs are inserted into peg-receiving holes in a pattern peg carrier provided with spaced rows of such peg-receiving holes, the following is provided, in combination: a holding arrangement operative for holding a pattern peg carrier of the type provided with spaced rows of peg-receiving holes, peg transport structure repeatedly moving back and forth between a first location and a second location, a peg feeding device activatable for feeding pegs into the peg transport structure when the peg transport structure is at the first location, a peg inserting device operative for inserting pegs into peg-receiving holes of the peg carrier whenever pegs are brought by the peg transport structure to the second location, and a control arrangement operable for controlling whether or not pegs are fed by the feeding device into the peg transport structure when the peg transport structure moves to the first location by selective activation of the peg feeding means.

16 Claims, 3 Drawing Figures

TEXTILE-PATTERN-PEG SELECTION AND INSERTION ARRANGEMENT

BACKGROUND OF THE INVENTION

The invention relates in general to arrangements for the insertion of pegs into the pattern peg carrier of Jacquard-type pattern-control arrangements for textile machines, in particular for circular knitting machines.

Additionally, the invention relates more specifically to peg-inserting arrangements of the type provided with peg-supply passages which are arranged more or less in register with peg-receiving holes in a pattern drum or pattern plate, with pegs being discharged from the peg-supply passages into selected ones of the peg-receiving holes under the control of slide-bars mounted for longitudinal reciprocation in a stationary guide structure, with the movement of the slide-bars being controlled by electromagnetic windings which are energized in accordance with the pattern to be established.

Peg-inserting arrangements having at least some of the aforementioned features are already known (for example from West German Offenlegungsschriften Nos. 2,235,139 and 2,114,385). In these known arrangements, all the pegs which are to be inserted into a row of peg-receiving holes are inserted into such holes simultaneously. In these known arrangements, the pushing members which push the pegs into the peg-receiving holes of the pattern drum are directly selectable and activatable; the pushing members simultaneously constitute both peg-selecting and also peg-inserting members.

However, the continuing development of such peg-inserting arrangements has shown that this doubling-up of functions, which would seem to be advantageous in so far as the cost of construction is concerned, is actually disadvantageous because with such doubling-up of functions, the force which must be exerted to effect selection of the pegs and the force which must be exerted to effect insertion of the pegs into the peg-receiving holes are necessarily closely interrelated, although in fact the forces which would be most optimal to effect these two different operations are not the same.

SUMMARY OF THE INVENTION

It is a general object of the invention to provide a peg-inserting arrangement so designed that the force which is exerted to effect selection of the pegs to be inserted and the force which is exerted to effect actual insertion of the selected pegs into the peg-receiving holes of the pattern drum or plate can be made completely independent of each other in such a manner as to result in a more reliable operation than heretofore known.

This object, and others which will become more understandable from the description, below, of specific embodiments, can be met, according to one advantageous concept of the invention, by providing a peg-inserting arrangement of the general type described above, in which the slide-bars are configurated and employed as selector slide-bars, with the control or selector electromagnets being provided on a carriage mounted for sliding reciprocating motion on a stationary guide structure, and including a sliding plate rigidly connected with the carriage and provided with a row of holes disposed in correspondence to the disposition of the peg-receiving holes in the pattern drum or pattern plate, with the sliding plate sliding from a peg-receiving location at which none or some or all of its holes are filled with pegs and then being transported along with such pegs to a second or peg-inserting location at which a separate peg-inserting device removes the pegs from the holes in the sliding plate and drives such pegs into the corresponding peg-receiving holes of the pattern drum or pattern plate.

Advantageously, according to the above-described preferred embodiment of the invention, the selector slide-bars are normally urged by means of biasing springs to a position in which they exert upon a spring associated with a respective peg supply passage a blocking force preventing the discharge of a peg. The selector slide-bars, under the control of electromagnets activated in dependence upon the pattern to be established, are pulled by magnetic force against the resisting force of their associated biasing springs through a shorter first or through a longer second distance. The selector slide-bars need only exert a relatively small blocking or clamping force in order to prevent discharge of pegs from the peg supply passages; accordingly, this relatively small force can be overcome by magnets of relatively small strength and/or dimensions. Additionally, when electromagnets are employed, for example, to counteract the effect of permanent magnets when a peg is not to be inserted into a particular peg-receiving hole, the consumption of electrical energy attributable to the peg-selecting operation is very low. Advantageously, each selector slide-bar can have associated with it an intermediate force-transmitting spring which indirectly exerts upon the bottom peg in the discharge end section of the peg supply conduit a force oriented transverse to the direction of travel of the pegs in the end section of the peg supply conduit. For example, use can be made of two clamping springs. However, as another possibility, the selector slide-bar can itself be designed to have spring-like characteristics or to have a portion with spring-like characteristics, for example by virtue of its material and/or configuration, in which event the selector slide-bar could itself directly exert the force which prevents the discharge of pegs from the end section of the peg supply conduit.

The carriage with the rigidly connected sliding plate is advantageously oriented for movement in direction perpendicular to the direction of the discharge end section of the peg supply passage and perpendicular to the direction of the peg-guiding passage located adjacent the peg-receiving holes of the pattern drum or pattern plate. Advantageously, at least the discharge end section of the peg supply passage is vertical, and the pegs are arranged in such end section end-to-end in single file. In this way, when the discharge end of the supply passage is unblocked, a peg can simply drop down into a suitable peg-receiving hole under the force of gravity alone, and then be transported to the peg-inserting location. The peg-receiving holes provided in the aforementioned sliding plate are advantageously through-holes passing from one to the opposite side of the sliding plate and oriented in the same direction as the discharge end sections of the peg supply passages and in the same direction as the peg-guiding passages provided at the peg-inserting location. In this way, a peg can enter into the peg-receiving hole provided in the sliding plate from one side of the sliding plate, and then be removed from such peg-receiving hole from the other side of the sliding plate.

The removal of the pegs from the peg-receiving recesses of the sliding plate and the driving of the pegs into the peg-receiving holes of the pattern drum or pattern plate, as already explained, is performed by a separate device. This device may for example be a pneumatic device operative for pushing pegs into peg-receiving holes. Alternatively, this device may be comprised of a row of reciprocating plungers disposed in correspondence to the spacing of the peg-receiving holes in one row of peg-receiving holes of the pattern drum, with all the plungers advantageously connected together by means of a common mounting stucture and being reciprocated in unison.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figures 1, 1A:
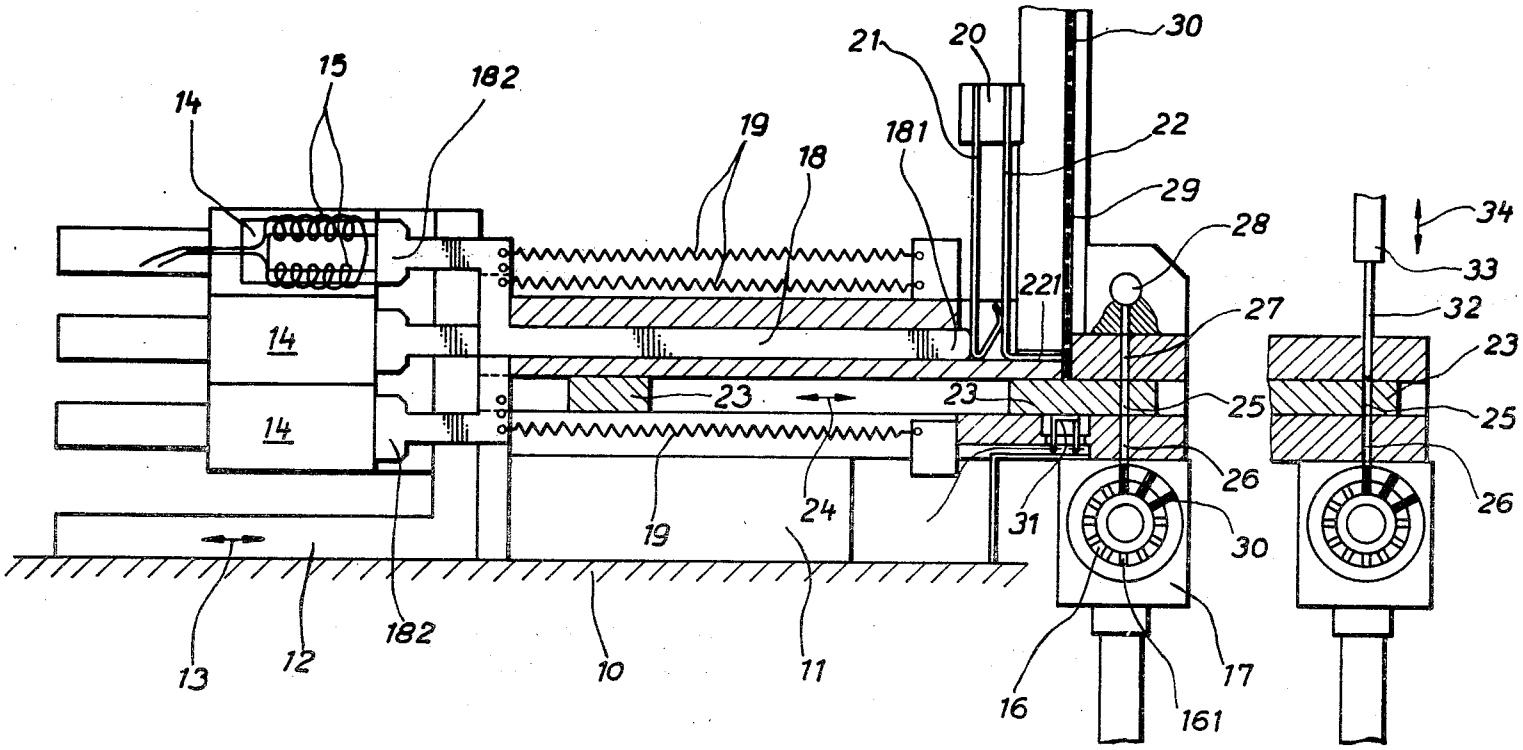
FIG. 1 is a partially schematic depiction of an exemplary embodiment of the invention.
FIG. 1*a* depicts a modified version of a portion of the arrangement shown in FIG. 1.

The illustrated peg selection and insertion arrangement is comprised of a schematically depicted base plate 10. Rigidly mounted on the base plate 10 is a stationary guide structure 11. Further mounted on the base plate 10 is a carriage 12 longitudinally reciprocable in the directions indicated by the double-headed arrow 13. The carriage 12 is longitudinally reciprocated by non-illustrated means, e.g., a motor whose output shaft drives a crankshaft to which is articulately connected a link connecting the crankshaft to the carriage 12 in the manner in which the piston rod of an internal combustion engine connects the crankshaft to the piston of the engine.

The carriage 12 carries a plurality of separate permanent magnets 14, each provided with two coils forming a respective control winding 15. When one of the control windings 15 is energized, the magnetic field which it develops substantially cancels the magnet field associated with the respective permanent magnet.

The number of permanent magnets 14 corresponds to the number of peg-receiving holes in one row of peg-receiving holes 161 of the pattern drum 16. The pattern drum 16 is provided with a plurality of axially extending rows of peg-receiving holes 161, the rows being circumferentially spaced from each other. The pattern drum 16 is indexably supported in a schematically depicted holding arrangement 17. The pattern drum 16, when held by the holding arrangement 17, can be indexed an angular distance corresponding to the circumferential spacing between two adjoining rows of peg-receiving holes.

In the illustrated embodiment, the permanent magnets are staggered in three different horizontal levels, for reasons of space. Specifically, each individual magnet 14 with its associated control winding 15 has a breadth (measured in direction normal to the picture plane of the drawing) greater than the axial spacing between adjoining peg-receiving holes in a single row of such holes on the drum 16. Consequently, in this particular embodiment, it would not be possible to arrange the magnets 14 side-by-side in the same horizontal level. It will be understood that whereas in the illustrated embodiment the permanent magnets 14 are arranged in three horizontal levels, more than three permanent magnets 14 are provided, and that in fact a multiple of three permanent magnets is provided.

Associated with each magnet 14 is a selector slide-bar 18. All the selector slide-bars 18 are arranged at the same horizontal level and are transversely spaced from each other by distances corresponding to the axial spacing between successive peg-receiving holes 161 in one axial row of such holes on the pattern drum 16. The horizontal slide-bars 18 are mounted in the stationary guide structure 11 for longitudinal reciprocation against the biasing force of respective return springs 19. The return springs 19 are tension springs which normally pull the horizontal slide-bars 18 into the illustrated rightmost or first position thereof. In this rightmost or first position, the end 181 of the horizontal slide-bar 18 normally presses against an associated one of a plurality of equalizer springs 21. The equalizer spring 21 is clamped at its upper end in a holding structure 20 and, at its lower end, transmits force from the end 181 of the horizontal slide-bar 18 to an associated clamping spring 22, the purpose of which will be explained in detail further below. The peg-clamping springs 21, 22 together constitute an intermediate spring device.

The left end 182 of each horizontal slide-bar 18 constitutes a pole shoe for the associated permanent magnet 14. It will be noted that, in correspondence to the staggered arrangement of the successive permanent magnets 14 in three different horizontal levels, the lefthand end portions of the slide-bars 18 are similarly staggered, with the left-hand end portions of some of the slide-bars 18 being bent so that the respective ends 182 will be located at the correct horizontal level.

In the illustrated rightmost position of the reciprocating carriage 12, in which the carriage 12 abuts against the stationary guide structure 11, the pole shoe ends 182 of the horizontal slide-bars 18 are in abutment against the respective ones of the permanent magnets 14. After the carriage 12 has reached the illustrated rightmost position, it reverses direction and travels towards the non-illustrated leftmost position thereof. The magnetic attractive force exerted by the permanent magnets 14 upon the respective pole shoe ends 182 of the slide-bars 18 is strong enough to cause the horizontal slide-bars 18 to travel in leftwards direction with the carriage 12, as the carriage 12 moves leftwards from the illustrated rightmost carriage position. However, as mentioned before, if any one of the control windings 15 is energized, the electromagnetic field thereby established substantially cancels out the magnetic field of the associated permanent magnet 14. Thus, if one or more of the control windings 15 is energized, the respectively associated slide-bars 18 will not travel with the leftwards-moving carriage 12 and will accordingly not reach its leftmost or second position.

Slidably mounted on the stationary guide structure 11 is a sliding plate 23 rigidly connected with the carriage 12. Accordingly, the sliding plate 23 shares exactly the longitudinal reciprocating movement of the carriage 12, as indicated by the double-headed arrow 24.

The right end portion of the sliding plate 23 is provided with a plurality of through-holes 25 arranged in a row extending normal to the picture plane of the drawing. The through-holes 25 are spaced from each other in exact correspondence to the spacing of the peg-receiving holes 161 in one row of such holes on the pattern drum 16. When the sliding plate 23 is in its illustrated rightmost position, constituting an inserting position as will become clearer subsequently, the row of through-holes 25 is in exact register with one row of peg-receiving holes 161 of the drum 16.

In the peg-inserting position depicted in FIG. 1, the through-holes 25 in the sliding plate 23 come into exact register with the peg-guiding bores 26 provided in the stationary guide structure 11, the spacing and location of the bores 26 likewise corresponding to that of the peg-receiving holes 161. Furthermore, when the sliding plate 23 is in the peg-inserting position depicted in FIG. 1, the through-holes are additionally in register with pressurized-air conduits 27 which are supplied with pressurized air at their upper ends from a distributor 28.

As just explained, in FIG. 1 the sliding plate 23 is shown in its rightmost or peg-inserting position. When the carriage 12 is moved leftwards to the leftmost position thereof, the sliding plate 23 assumes its leftmost or peg-receiving position. In the peg-receiving position, the through-holes 25 in the sliding plate 23 are in register with the discharge end portions 29 of a plurality of peg supply passages. There is one such peg supply passage for each peg-receiving hole 161 in a row of peg-receiving holes on the pattern drum 16. Moreover, as will be appreciated, the spacing between adjoining end portions 29 of the peg supply passages corresponds to the spacing between the peg receiving holes 161 in one row of such holes.

The pegs themselves are identified by reference numeral 30 and will be seen to fill the interior of the respective end portions 29 of the peg supply passages, lined up end-to-end. The pegs are supplied into the peg supply passages from a non-illustrated central source of pegs.

Associated with each one of the end portions 29 of the peg supply passages is a respective one of the plurality of clamping springs 22. The end portion 221 of the clamping spring 22 projects into the interior of the lower end portion of the respective peg supply passage in such a manner as to normally press sideways against the last or lowermost peg in the passage section 29, thereby securely clamping such lowermost peg in the passage section 29 and preventing discharge of the peg. Specifically, this clamping action occurs when the horizontal slide-bar 18 is in the illustrated rightmost position thereof, with its end 181 pressing against and transmitting force through the equalizer spring 21, in consequence of the rightwards pull exerted upon the slide-bar 18 by its respective return spring 19.

It will be understood that, when the carriage 12 moves from its illustrated rightmost position towards its non-illustrated leftmost position, the clamping in question will not occur unless the magnetic field of the magnet 14 associated with the respective slide-bar 18 is cancelled by energization of the respective control winding 15. Furthermore, it will be understood that when the sliding plate 23 is in the peg-receiving position, with the through-holes 25 in register with the end sections 29 of the peg supply passages, the clamping action of the clamping springs 22 will prevent pegs from falling by force of gravity into the various through-holes 25.

Beneath each one of the discharge end sections 29 of the peg supply passages there is located in the stationary guide structure 11, separated from the end section 29 by the sliding plate 23, a respective one of a plurality of electrical detector contacts 31. If the sliding plate 23 is in the leftmost or peg-receiving position, with the through-holes 25 in register with the ends 29 of the peg supply passages, and if in the manner described above the clamping spring 22 is released thereby permitting a peg 30 to fall into one of the through-holes 25, the presence of such peg 30 in such through-holes 25 will be detected by the respective one of the detector contacts 31.

The arrangement depicted in FIG. 1 operates as follows:

The carriage 12 is moved in rightwards direction until it assumes the illustrated rightmost position, whereupon the permanent magnets 14 all come into abutment with the pole shoe ends 182 of the respective horizontal slide-bars 18.

Next, the carriage 12 starts its return movement in the leftwards direction. During a portion of this leftwards return movement of the carriage 12, all the horizontal slide-bars 18 are carried along, because during this portion of the return movement none of the control windings 15 is energized. As a result of this leftwards movement of all the slide-bars 18, the pressure on the clamping springs 22 is temporarily released, because the ends 181 of the slide-bars 18 move out of contact with the equalizing springs 21. Accordingly, the clamping of the bottom peg located in each of the plurality of peg supply passages is temporarily terminated. It will be understood that, as the carriage 12 performs its leftwards return stroke, the sliding plate 23 rigidly connected thereto also moves leftwards.

After the carriage 12 has performed a fraction of its leftwards return stroke—i.e., substantially before the through-holes 25 come into register with the end sections 29 of the peg supply passages, or, in other words, substantially before the sliding plate 23 has reached its peg-receiving position—selected ones of the control windings 15 are energized. Those windings 15 are energized which correspond to peg-receiving holes 161 which are not to receive a peg.

The energization of one of the control windings 15 results in termination of the holding and pulling action exerted upon the pole shoe end 182 by the respective permanent magnet 14. Accordingly, when one of the control windings 15 becomes energized, at substantially that moment the leftwards travel of the respective slide-bar 18, during the leftwards return stroke of the carriage 12, stops. Since the slide-bar 18 is no longer being pulled leftwards by the respective permanent magnet 14, the respective return spring 19 pulls the slide-bar 18 rightwards, causing the slide-bar 18 to return to the illustrated rightmost position thereof. Accordingly, the slide-bar 18 with its end 181 once more causes the clamping spring 22 to clamp the bottom peg 30 inside the respective peg supply passage section 29, thereby preventing downwards falling of the bottom peg 30 when the through-holes 25 come into register with the passage sections 29.

Meanwhile, the carriage 12 continues to travel leftwards until it reaches its leftmost position. Accordingly, the sliding plate 23 reaches its leftmost or peg-receiving position, in which the through-holes 25 are in register with the peg supply passage sections 29. Upon establishment of such register, th pegs in those of the passages 29 which are associated with unenergized control windings 15 drop into the respective through-holes 25. When a peg 30 falls into a respective through-hole 25, this is detected by the respective one of the plurality of detector contacts 31. The detector contacts 31 are connected to a (non-illustrated) monitoring arrangement which provides an indication to the operator of whether pegs have dropped into those holes 25 which correspond to the selected pattern drum holes 161.

Figure 2:
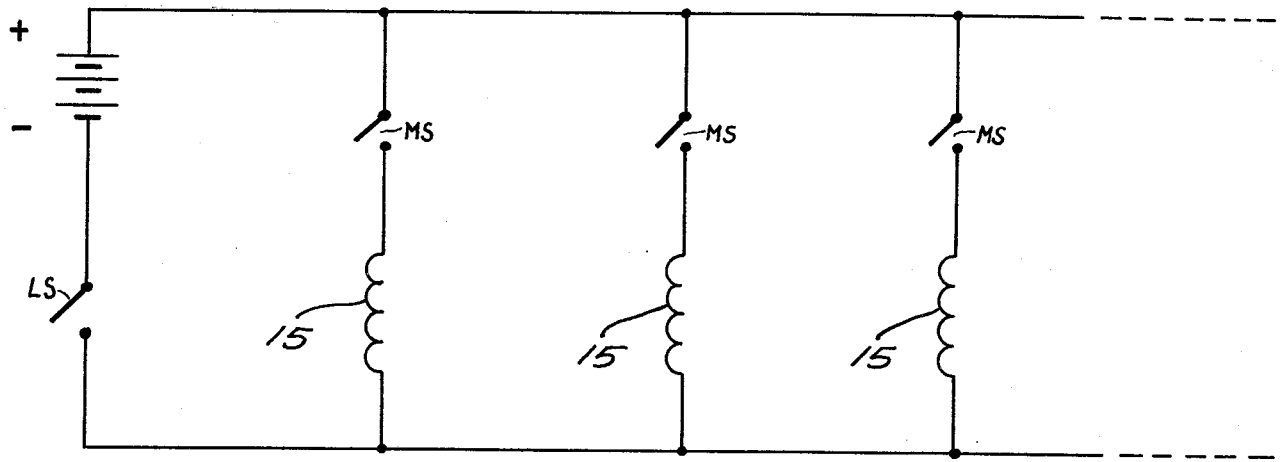
FIG. 2. depicts a selecting circuit.

For example, the construction of the hole-selecting means, the construction of the aforementioned monitoring arrangement, and the construction of the synchronizing means for correctly timing the energization of selected ones of the control windings 15, could be as follows: The hole-selecting means could consist (see FIG. 2) of a panel of manually settable two-position electrical switches MS, arranged in a row, and corresponding in number to the number of peg-receiving holes 161 in one axial row of the pattern drum 16. Each such manually activated switch MS could be connected in the current path of one respective control winding 15, with such current path further including a source of electrical energy. Each such current path could further include a limit switch LS mechanically activatable by means of a trip on the carriage 12, in such a manner that when the carriage 12 begins to move leftwards in the performance of its return stroke the limit switch LS becomes closed after a predetermined fraction of the return stroke has been performed. Thus, when the limit switch LS becomes closed, if the respective manually activatable switch MS is in closed position, the respective control winding 15 will become energized, and the respective one of the peg-receiving holes 161 will not receive a peg, for reasons which should be clear from the foregoing description.

The aforementioned monitoring arrangement could very simply consist of a plurality of current paths each including a respective energy source and each including one of the detector switches 31. Each of these current paths would furthermore include another switch mechanically coupled to a respective one of the aforementioned manually settable switches of the selecting panel. Each such mechanically coupled switch would be arranged to assume the closed position when the associated manually activated switch MS of the selector arrangement is in the "no peg" setting. Accordingly, if, due to malfunction, a peg 30 drops into one of the through-holes 25 associated with a selector switch MS which is in the no peg setting, then the respective current path would be completed. Accordingly, it would be merely necessary to provide in each of these current paths of the monitoring means a self-locking relay. The self-locking relay could be comprised of a switch which controls the energization of an indicator lamp, with the indicator lamp being located on the selector panel adjacent the respective manually settable selector switch MS. Accordingly, if a peg 30 is improperly dropped into one of the through-holes 25, the lamp adjoining the switch MS corresponding to such through-hole would light up, indicating malfunction, and specifically indicating which peg has been improperly filled into a hole 25. Furthermore, each such self-locking relay can be connected in circuit with a motor shutoff switch which, upon energization of the self-locking relay, terminates reciprocation of the carriage 12, so that the necessary repair can be made. The termination of the reciprocation of the carriage 12 can be simply accomplished by interrupting the flow of energizing current to the carriage drive motor.

A more complicated construction for the selecting and monitoring means would differ from the one just described in the following respects. Instead of a single row of manually settable selector switches MS, there could be provided as many such rows as there are axial rows on one drum 161. The cooperation between a single such row of manually activatable selector switches MS and the various current paths described above would be the same, except that there would additionally be provided multi-position rotary switches for connecting into the current paths described above successive ones of the rows of manually activatable selector switches MS. The multi-positive rotary switches would be mechanically coupled to the indexing mechanism which indexes the drum 16, for example a stepper motor. In addition, there would be provided adjacent each row of manually settable selector switches MS an indicator lamp to indicate when that particular row of selector switches is in circuit with the various current paths described above. Successive ones of such indicator lamps could be connected to a power source by means of a further multi-position rotary switch mechanically coupled to the pattern drum indexing mechanism.

In both the first and second construction described above for the selector and monitoring arrangement, there would be provided in the holding current path of each self-locking relay, an interruptor switch for deenergizing the relay, for example, after the malfunction has been corrected.

In any event, the sliding plate 23 is now in the leftmost peg-receiving position thereof, and some or all of the through-holes 25 in the plate 23 have received pegs 30.

The carriage 12 now begins its rightwards or forwards stroke, back to the illustrated rightmost position thereof. When the illustrated rightmost position is reached, the through-holes 25, as explained above, come into register with both the peg-guiding bores 26 and the peg-receiving holes 161 themselves, on the one hand, and furthermore come into register with the pressurized-air conduits 27, on the other hand. It will be noted that the discharge end sections 29 of the peg supply passages and the peg-guiding passages 26 are all oriented perpendicular to the direction of movement of the carriage 12 and the sliding peg-transporting plate 23. As defined above, this position of the carriage 12 and of the sliding plate 23 constitutes the peg-inserting position. The pressurized air in conduits 27 pushes the pegs 30 out of the through-holes 25, through the peg-guiding bores 26 and into the respective peg-receiving holes 161. The pattern drum 16 is then indexed, so that the next axially extending row of peg-receiving holes 23 comes into register with the peg-guiding bores 26, and the entire operation explained above is repeated.

The driving of the pegs 30 into the peg-receiving holes 161 of the pattern drum 16 need not be performed by means of pressurized air, but could instead be performed by means of reciprocating pusher members 32, as depicted in FIG. 1a. The reciprocating pusher members 32 are mounted in a common support 33 or even formed integral with the support 33, and are longitudinally reciprocated as indicated by the double-headed arrow 24. During their downwards stroke, they push any pegs 30 which may be present in the through-holes 25 down through the respective peg-guiding bores 26 into the respective pattern-drum peg-receiving holes 161. As will be evident, the drive for the reciprocating pusher members 32 will be synchronized with the drive for the reciprocating carriage 12. Indeed, it is advantageous to employ a single drive motor mechanically coupled to the carriage 12 and to the holder 13, to ensure sufficiently exact synchronism. Moreover, the (non-illustrated) indexing device for the pattern drum 16 can also be driven from such single drive motor, to thereby further guarantee sufficiently exact snychronization of the entire peg selection and insertion arrangement.

It will be understood that each of the elements described above, or two or more together, may also find a useful application in other types of constructions differing from the types described above.

While the invention has been illustrated and described as embodied in an arrangement for inserting pegs into the peg-receiving holes of a pattern drum, as opposed to a pattern carrier of different configuration such as a pattern plate provided with peg-receiving holes, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a patterning arrangement for textile machines and the like, particularly for circular knitting machines, of the type wherein pattern pegs are inserted into peg-receiving holes in a pattern peg carrier provided with spaced rows of such peg-receiving holes, in combination, holding means for holding a pattern peg carrier of the type provided with spaced rows of peg-receiving holes; a plurality of peg supply passages having respective peg discharge end sections disposed in correspondence to the disposition of peg-receiving holes in one row of the carrier; a stationary guide structure; a plurality of selector slide-bars corresponding in number to the number of peg-receiving holes in one row of the carrier, said selector slide-bars being mounted for longitudinal sliding movement on said stationary guide structure, each of said selector slide-bars being associated with a respective one of said supply passages and being operative in a first position for preventing the discharge of a peg from the respective supply passage and being operative in a second position for permitting the discharge of a peg from the respective supply passage; a carriage mounted for sliding movement relative to said stationary guide structure; a peg-transporting structure connected to said carriage and sharing the movement of said carriage, said peg-transporting structure being provided with a row of peg-receiving portions disposed in correspondence to the disposition of peg-receiving holes in one row of the pattern peg carrier, said peg-transporting structure being movable with said carriage between a first location and a second location, said second location being a peg-receiving location adjacent said peg discharge end sections for receiving pegs from selected ones of said peg supply passages in dependence upon the positions of said selector slide bars, and said first location being a peg-insertion location; peg-inserting means operative when said peg-transporting structure moves to said peg-insertion location for removing the transported pegs from said peg-receiving portions of said peg-transporting structure and furthermore operative for pushing the pegs into peg-receiving holes of the pattern peg carrier; and a plurality of magnet units mounted on said carriage for movement therewith and separately activatable for causing selected ones of said selector slide-bars to share the movement of said carriage and move to said second position when said peg-transporting structure moves to said second location.

2. In a patterning arrangement as defined in claim 1, wherein each of said selector slide-bars when in said first position exerts upon a peg located in the discharge end section of the respective peg supply passage a blocking force preventing discharge of that peg, and further including a plurality of biasing springs each associated with a respective one of said selector slide-bars and operative for normally biasing the respective selector slide-bar to said first position,

3. In a patterning arrangement as defined in claim 2, wherein each of said magnet units has an activated first state and an unactivated second state, and further including selecting means settable for separately selecting the state of activation of each of said magnet units, means operative when said carriage leaves said first location and moves towards said second location for initially maintaining all of said magnet units in said first state to cause all of said selector slide-bars to leave said first position and initially travel with said carriage towards said second location, and means operative when said carriage has travelled a fraction of the distance from said first to said second location for automatically causing those of said magnet units not already in the selected state of activation to assume the selected state of activation thereby causing the respectively associated selector slide-bars to be immediately returned by their respective biasing springs to said first position while the remainder of said selector slide-bars continue to travel with said carriage.

4. In a patterning arrangement as defined in claim 2, wherein pegs travel through said discharge end sections of said peg supply passages in a predetermined travel direction, and further including a plurality of intermediate spring devices each associated with a respective one of said peg supply passages, and each so disposed that when the respective selector slide-bar is in said first position said selector slide-bar exerts upon the intermediate spring device a blocking force which the intermediate spring device transmits to a peg located in the respective discharge end section applying the force to such peg in direction transverse to said predetermined travel direction.

5. In a patterning arrangement as defined in claim 4, wherein each of said spring devices comprises a pair of peg-clamping springs.

6. In a patterning arrangement as defined in claim 1, wherein said peg-inserting means comprises a row of peg-guiding passages at said peg-insertion location disposed in register with the peg-receiving holes of one row of such holes of the peg carrier, and wherein said discharge end sections and said peg-guiding passages are all oriented perpendicular to the direction of movement of said carriage and of said peg-transporting structure.

7. In a patterning arrangement as defined in claim 1, wherein at least said discharge end sections of said peg supply passages are vertical and filled with pegs arranged in single file end-to-end.

8. In a patterning arrangement as defined in claim 6, wherein each of siad peg-receiving portions of said peg-transporting structure is a portion provided with a respective peg-receiving through-hole passing through the peg-transporting structure, said through-holes, said peg discharge end sections and said peg-guiding passages all being elongated in one and the same direction.

9. In a patterning arrangement as defined in claim 8, wherein said peg discharge end sections are so disposed that when said peg-transporting structure is at said peg-receiving location pegs discharged into said through-holes enter the latter from one side of said peg-transporting structure, and wherein said peg-guiding passages of said peg-inserting means are so disposed that when said peg-transporting structure is at said peg-insertion location pegs removed from said through-holes by said peg-removing means leave said through-holes at the other side of said peg-transporting structure.

10. In a patterning arrangement as defined in claim 1, and further including a plurality of detector units each associated with a respective one of said peg-receiving portions of said peg-transporting structure and each operative for detecting whether or not a peg has been inserted into the respective peg-receiving portion of said peg-transporting structure when the latter is at said second location.

11. In a patterning arrangement as defined in claim 1, wherein said peg-inserting means comprises pneumatic means operative for removing the transported pegs from said peg-receiving portions of said peg-transporting structure by pneumatic force and for pushing the pegs into peg-receiving holes in the pattern peg carrier by pneumatic force.

12. In a patterning arrangement as defined in claim 1, wherein said peg-inserting means comprises pusher members operative for driving the pegs removed from saiad peg-receiving portions of said peg-transporting structure into peg-receiving holes in the pattern peg carrier.

13. In a patterning arrangement as defined in claim 12, wherein said pusher members are arranged in a group comprised of pusher members equal in number to the number of peg-receiving holes in one row of such holes of the carrier member, and wherein said pusher members are jointly mounted for unison reciprocating movement.

14. In a patterning arrangement as defined in claim 1, wherein each of said magnet units has an activated first state and an unactivated second state, and wherein each of said magnet units is comprised of a permanent magnet and a control winding energizable to establish a magnetic field at least in part cancelling out the magnetic field of the associated permanent magnet, and wherein each magnet unit is in said activated first state when the respective control winding is unenergized and in said unactivated second state when the respective control winding is energized.

15. In a patterning arrangement for textile machines and the like, particularly for circular knitting machines, of the type wherein pattern pegs are inserted into peg-receiving holes in a pattern peg carrier provided with spaced rows of such peg-receiving holes, in combination, holding means operative for holding a pattern peg carrier of the type provided with spaced rows of peg-receiving holes; a peg transport plate repeatedly moving back and forth between a first location and a second location, said peg transport plate being provided with a plurality of peg-receiving holes corresponding in number and in disposition to the peg-receiving holes on the pattern peg carrier; peg feeding means activatable for feeding pegs into said peg transport means when said transport plate is at said first location; peg inserting means operative for inserting pegs into peg-receiving holes of the peg carrier when pegs are brought by said transport plate to said second location; and control means for controlling by selective activation of said peg feeding means whether or not pegs are fed by the said feeding means into said transport plate when said transport plate is at said first location.

16. In a patterning arrangement as defined in claim 15, wherein said peg feeding means is comprised of a plurality fo discrete separately activatable peg feeding units corresponding to said plurality of holes of said peg transport plate, and wherein said control means comprises means operable for selecting which of said holes of said plate are to receive pegs from said peg feeding means when said transport plate moves to said first location by selective activation of different ones of said plurality of separately activatable peg feeding units.

* * * * *